US005716138A

United States Patent [19]

Southwell

[11] Patent Number: 5,716,138

[45] Date of Patent: Feb. 10, 1998

[54] REINFORCED HOLD-OPEN BAG

[75] Inventor: James D. Southwell, Palatine, Ill.

[73] Assignee: Tenneco Packaging, Evanston, Ill.

[21] Appl. No.: 754,291

[22] Filed: Nov. 20, 1996

[51] Int. Cl.[6] ..... B65D 30/20

[52] U.S. Cl. ..... 383/104; 383/33; 383/120

[58] Field of Search ..... 383/14, 17, 33, 383/34, 35, 104, 120, 119

[56] References Cited

U.S. PATENT DOCUMENTS

| | | | |
|---|---|---|---|
| 768,203 | 8/1904 | Ormsbee, Jr. | 383/120 X |
| 2,126,203 | 8/1938 | Miskella | 383/33 X |
| 2,774,531 | 12/1956 | Rosenthal | 383/33 X |
| 3,294,312 | 12/1966 | Mullins | 383/120 X |
| 4,848,930 | 7/1989 | Willliams et al. | 383/120 X |
| 5,080,043 | 1/1992 | Fields | 383/33 X |
| 5,529,394 | 6/1996 | Davoren | 383/61 |

FOREIGN PATENT DOCUMENTS

| | | | |
|---|---|---|---|
| 2281553 | 3/1995 | United Kingdom | 383/120 |

*Primary Examiner*—Jes F. Pascua
*Attorney, Agent, or Firm*—Arnold, White & Durkee

[57] ABSTRACT

A flexible folding bag having a hold-open top to facilitate easy loading of the bag. The hold-open top is formed on the top edge of the bag from a plurality of top flaps connected to top edges of the bag sidewalls. The top flaps are adapted to be folded inwardly by a user to form one or more cuffs within said opening for maintaining the bag in a maximally open position. The cuffs hold the bag open by applying outward pressure on gusseted sidewalls of two opposing width panels and/or by applying outward pressure on the corners of the bag. In addition to holding the bag in an open position, the cuffs cause the top opening of the bag to be tear-resistant.

16 Claims, 2 Drawing Sheets

REINFORCED HOLD-OPEN BAG

FIELD OF THE INVENTION

The present invention relates generally to the field of flexible folding bags and, more particularly, to a flexible folding bag including a reinforced hold-open top to facilitate easy filling of the bag.

BACKGROUND OF THE INVENTION

Flexible folding bags provide a well known and popular means of storing or disposing of a variety of materials. Their popularity may be attributed to their versatility, low cost and collapsibility for easy storage and transport. Flexible folding bags typically include a top opening formed between two opposing length panels fixedly connected to two gusseted width panels, and a closed bottom bridging across the opposing length and width panels. The gusseted width panels include respective score lines in their respective centers to permit inward folding of the width panels and subsequent collapsing of the bag. When the bag is in its collapsed position, the two halves of each width panel on opposite sides of the associated score line are folded on top of each other and sandwiched between the length panels. When the bag is opened, the two halves of the width panel become unfolded and are moved outwardly to create a bridge between the opposing length panels of the bag.

Typically, however, because of the prominence of the score line between the two halves of each gusseted width panel, opening of the bag does not completely eliminate the fold between the two halves of each width panel. Rather, the two halves of each width panel remain at least partially folded relative to each other, causing the bag opening to collapse inwardly and become either reduced in size or closed completely unless external force is applied by the user to retain the bag in an open position. This can become a significant distraction and inconvenience to the user, especially when the bag is being used for the loading and storage of products such as lawn and yard waste in which the user typically does not have a free hand to hold open the bag. Further, unless the bag is free-standing the user must endure the related problem of holding the bag in an upright position.

Consequently, there is a need for a flexible folding bag having a top opening which is adapted to be maintained in its maximum open position without being held open by a user. Further, the bag should be free standing to facilitate loading of lawn and yard waste or other products without the need to be held in an upright position by a user. The bag and its top opening should also be sturdy enough to resist tearing during loading and subsequent storage of the lawn and yard waste or other products. Accordingly, the present invention is directed to providing a flexible folding bag that satisfies the aforementioned needs and overcomes or at least reduces the effects of one or more of the problems set forth above.

SUMMARY OF THE INVENTION

In accordance with one aspect of the present invention, there is provided a flexible folding bag comprising a plurality of side panels hingedly connected and folded relative to each other to form a first and second pair of opposing sides of the bag intersecting at corners and forming an opening of the bag therebetween. A plurality of bottom panels are hingedly connected to bottom edges of the side panels and folded inwardly from the sides to form the bottom of the bag. A plurality of top flaps are hingedly connected to top edges of the side panels along transverse fold lines. The top flaps are adapted to be folded inwardly by a user to form one or more cuffs within the bag opening for maintaining the bag in a maximally open position. The cuffs hold the bag open by frictionally engaging with and applying outward pressure to gussets on two opposing side panels of the bag and/or by applying outward pressure to corners of the bag.

BRIEF DESCRIPTION OF THE DRAWINGS

The foregoing and other advantages of the invention will become apparent upon reading the following detailed description and upon reference to the drawings in which.

Figure 1:
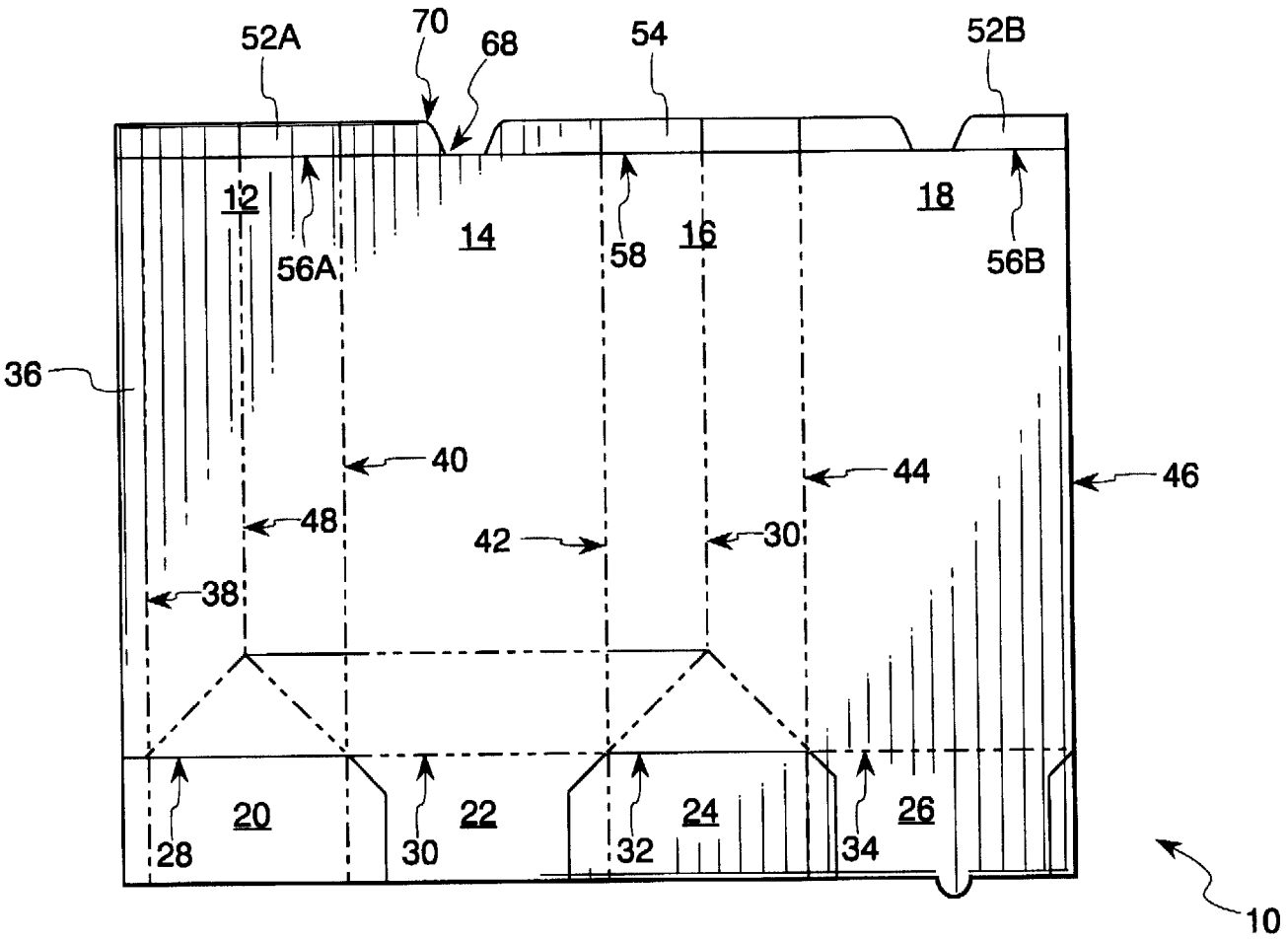
FIG. 1 is a top view of a blank used to form a flexible folding bag having a hold-open top according to one embodiment of the invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, a blank from which a flexible folding bag having a hold-open top may be manufactured according to one embodiment of the invention is illustrated and generally designated by a reference numeral 10. While the foregoing description of the blank 10 will be made with reference to the specific dimensions and shapes depicted in FIG. 1, it should be appreciated that the blank 10 may be varied according to the level of ordinary skill in the art to produce containers having other dimensions and shapes still falling within the scope of the invention.

The blank 10 is comprised of four consecutively joined rectangular side panels, including a first width panel 12, a first length panel 14, a second width panel 16 and a second length panel 18. The four side panels 12, 14, 16 and 18 are connected to four corresponding rectangular bottom panels, including a first bottom width panel 20, a first bottom length panel 22, a second bottom width panel 24 and a second bottom length panel 26, along respective score lines 28, 30, 32 and 34. The first width panel 12 and corresponding first bottom width panel 20 have a glue flap 36 hingedly attached to their outer edges along a score line 38. Alternatively, the glue flap 36 may be attached to the outer edges of the second length panel 18 and corresponding second bottom length panel 26. The first length panel 14 is hingedly attached to the first width panel 12 along a score line 40. The second width panel 16 is hingedly attached to the first length panel 14 along a score line 42. The second length panel 18 is hingedly attached to the second width panel 16 along a score line 44. The second length panel 18 has a free outer edge 46.

The first and second width panels 12 and 14 are gusseted to facilitate collapsibility of the bag. The gussets are defined by score lines 48 and 50 in the center of width panels 12 and 14, respectively. A partial top flap 52a is hingedly connected to top edges of the first width panel 12 and the first length panel 14 along a score line 56a, and a partial top flap 52b is hingedly connected to a top edge of the second length panel 18 along a score line 56b. The partial top flaps 52a and 52b are adapted to be joined together by means of the glue flap 36 to define a first top flap 52 of the bag. A second top flap 54 is hingedly connected along a score line 58 to top edges of the first length panel 14, second width panel 16 and second length panel 18.

As will be appreciated by those skilled in the art, the blank 10 may be equipped with different numbers or configurations of top flaps depending on the needs of the user. For example, the bag may be equipped with only one top flap or several top flaps, which may extend across the top edges of the side panels to a greater or lesser extent than the embodiment shown in FIG. 1. Preferably, however, regardless of the number of top flaps, portions of the top flaps should be positioned above the score lines 38, 40, 42, 44, 48 and 50 of the blank 10, so that when the blank 10 is formed into a bag and the flaps are folded over, they will frictionally engage with and apply outward pressure to the gussets 48 and 50 and corners 38, 40, 42 and 44 of the bag in order to maintain the bag in a maximally open position. Moreover, it will be appreciated that the side and bottom panels of the blank 10 may be comprised of multiple layers so that the blank 10 may be formed into a multiple layer or multi-wall bag.

The blank 10 is adapted to be assembled to form a collapsible bag in the manner of the S.O.S. (self-opening sack) style or other suitable means known in the art. Preferably, the blank 10 is comprised of a fibrous substrate having a degree of stiffness such as paper or spun-bonded HDPE, so that the bag formed from the blank 10 will be free standing when opened, and so that the bag will be resistant to tearing. The bag may be used in any of several applications, such as the storage of lawn and yard waste or the storage of granular products, to name but a few. As will be appreciated by those skilled in the art, the bag may be composed of either of several alternative materials or layers of materials depending on the application of the bag. After the bag is assembled and glued together, it is typically provided to users in a collapsed position. In its collapsed position, the two halves of each of the first and second width panels 12 and 16 on opposite sides of the respective score lines 48 and 50 are folded on top of each other and sandwiched between the first and second length panels 14 and 18. When the bag is opened, the two halves of each of the first and second width panels 12 and 16 become unfolded and are moved outwardly to create a bridge between the first and second length panels 14 and 18.

Figure 2:
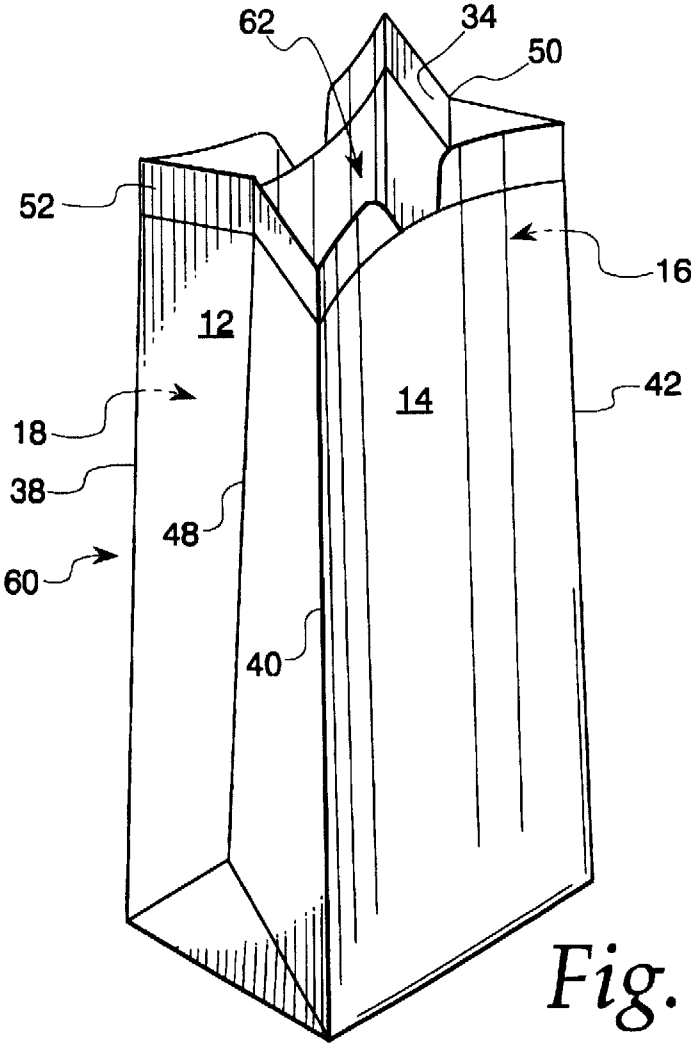
FIG. 2 is a perspective view of the flexible folding bag formed from the blank of FIG. 1 in an initial opened position.

Turning now to FIG. 2, there is depicted a flexible folding bag 60 made from the blank 10 described in relation to FIG. 1 in an initial open position. The width panels 12 and 16 and length panels 14 and 18 form opposing sides of the bag 60, while the score lines 38, 40, 42 and 44 form the corners of the bag. A bag opening 62 is formed interior to the sides of the bag. The score lines 48 and 50 define gussets on each of the width panels 12 and 16, respectively. As depicted in FIG. 2, the initial open position of the bag 60 does not place the bag opening 62 in a maximally open position. Rather, the bag opening 62 is at least partially closed as a result of the gusseted width panels 12 and 16 collapsing inwardly along the score lines 48 and 50. As in the prior art, the bag opening 62 will remain partially or perhaps completely closed unless external force is applied to retain the bag 60 in an open position.

Figure 3:
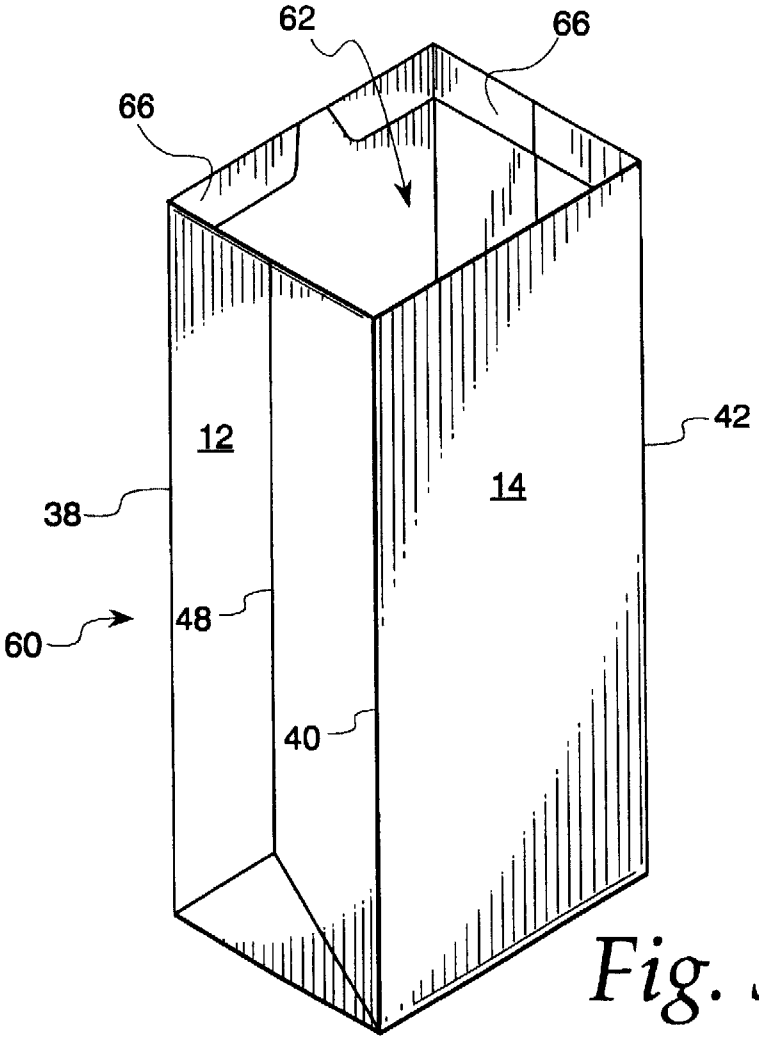
FIG. 3 is a perspective view of the flexible folding bag depicted in FIG. 2 after a folding step has been performed to maintain the opening in an open position.

Unlike the prior art, however, the external force need not be supplied by a user's free hand. As depicted in FIG. 3, the force needed to hold open the bag 60 may be supplied by first and second cuffs 64 and 66 formed by simply folding down the first and second top flaps 52 and 54, respectively. The quantity, configuration, length and width of the top flaps may be varied to produce a corresponding variation in the quantity, configuration, length and width of cuffs. However, it is preferred that the cuffs be placed over the gussets 48 and 50 and corners 38, 40, 42 and 44 of the bag in order to maintain the bag in a maximally open position.

In the embodiment shown in FIG. 3, each of the cuffs 64 and 66 has a width of approximately one-third the distance between the gussets 48 and 50 and their respective nearest corners 38, 40 and 42, 44, and a length of approximately four times the aforementioned distance. The first cuff 64 frictionally engages with and applies outward pressure on the score line 48 and the corners 38 and 40, while the second cuff 66 frictionally engages with and applies outward pressure on the score line 50 and the corners 42 and 44. The outward pressure on the gussets and corners of the bag cause the bag to be placed in its maximally open position without requiting it to be held open by a user. Thereafter, the bag 60 is maintained in its maximally open position by the combination of score memory and outward pressure on the gussets and corners of the bag. Accordingly, the bag 60 is especially adapted for use in applications in which the user may not have a free hand to hold open the bag, such as for the loading of lawn and yard waste.

Referring again to FIG. 1, it is noted that the outer edges of the top flaps 52 and 54 include a concave corner 68 and a convex corner 70. The concave corner 68 is formed by angling the outer edge of the top flaps at about twenty degrees downwardly and outwardly from the convex corner 70. The convex corner 70 is formed by rounding off the outer edges of the top flaps 52 and 54. The concave corner is provided to reduce the likelihood of tearing the bag 60. It has been found that a bag having a top flap with concave corners 68 is less likely to tear than a bag having top flaps with ninety degree corners. The convex corner 70 is provided to reduce the likelihood of paper cuts or similar irritations or injuries to the user during manipulation of the top flaps. However, as can be appreciated by those skilled in the art, the angle and configuration of both corners 68 and 70 may be varied to suit the needs of the user without departing from the spirit and scope of the present invention.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A flexible folding bag comprising:

a plurality of side panels hingedly connected and folded relative to each other to form a first and second pair of opposing sides intersecting at corners, said first and second pair of opposing sides forming an opening therebetween, said first pair of opposing sides defining a pair of length panels and said second pair of opposing sides defining a pair of width panels, said width panels including respective center score lines defining respective gussets;

a plurality of bottom panels hingedly connected to bottom edges of said side panels and folded inwardly from said opposing sides to form a bottom; and a plurality of top flaps hingedly connected to top edges of said side panels along transverse fold lines, said top flaps being folded inwardly to form one or more cuffs within said opening, said one or more cuffs integrally extending about said corners, said gussets and said center score lines, said one or more cuffs engaging with and applying outward pressure on one or more of said width panels.

2. The flexible folding bag of claim 1 wherein said width panels are adapted to collapse inwardly along said respective center score lines, each of said one or more cuffs engaging with and applying outward pressure on said gussets to prevent said width panels from collapsing inwardly and to maintain said bag in a maximally open position.

3. The flexible folding bag of claim 2 wherein each of said one or more cuffs engages with and applies outward pressure on said respective center score lines.

4. The flexible folding bag of claim 3 wherein each of said one or more cuffs engages with and applies outward pressure on at least one of the corners of said bag.

5. The flexible folding bag of claim 4 wherein each of said one or more cuffs includes a top edge defined by said transverse fold lines, a bottom edge parallel to said transverse fold lines, and two outer edges each extending downwardly and inwardly from said top edge toward said bottom edge.

6. The flexible folding bag of claim 5 wherein said bag is comprised of a material having a degree of stiffness sufficient to allow said bag to be free-standing.

7. The flexible folding bag of claim 6 wherein said center score lines on said respective width panels are separated from adjacent ones of the corners of said bag by a distance x, and said top and bottom edges of said cuffs are separated by a distance of approximately one-third of the distance x.

8. A flexible folding bag comprising:

a plurality of side panels hingedly connected and folded relative to each other to form a first and second pair of opposing sides intersecting at corners, said first and second pair of opposing sides forming an opening therebetween, said first pair of opposing sides defining a pair of length panels and said second pair of opposing sides defining a pair of width panels, said width panels including respective center score lines defining respective gussets, said width panels adapted to collapse inwardly along said respective center score lines, said center score lines on said respective width panels being separated from adjacent ones of the corners of said bag by a distance x;

a plurality of bottom panels hingedly connected to bottom edges of said side panels and folded inwardly from said opposing sides to form a bottom; and a plurality of top flaps hingedly connected to top edges of said side panels along transverse fold lines, said top flaps being folded inwardly to form one or more cuffs within said opening, said one or more cuffs including a top edge defined by said transverse fold lines, a bottom edge parallel to said transverse fold lines, said top and bottom edges of said cuffs being separated by a distance of approximately one-third of the distance x, and two outer edges each extending downwardly and inwardly from said top edge toward said bottom edge, said two outer edges of said cuffs being separated by a distance of approximately four times the distance x, said one or more cuffs frictionally engaging with and applying outward pressure on one or more of said width panels and said gussets, to prevent said width panels from collapsing inwardly and to maintain said bag in a maximally open position, said one or more cuffs engaging with and applying outward pressure on said respective center score lines and at least one of said corners;

said bag being comprised of a material having a degree of stiffness sufficient to allow said bag to be free-standing.

9. A free-standing flexible folding bag comprising:

four side panels hingedly connected and folded relative to each other to form a first and second pair of opposing sides intersecting at corners, said first and second pair of opposing sides forming an opening therebetween, said first pair of opposing sides defining a pair of length panels and said second pair of opposing sides defining a pair of width panels, said width panels including respective center score lines defining respective gussets, said center score lines being separated from adjacent ones of said corners of said bag by a distance x, said width panels adapted to collapse inwardly along said center score lines;

a plurality of bottom panels hingedly connected to bottom edges of said side panels and folded inwardly from said opposing sides to form a bottom;

two top flaps hingedly connected to top edges of said side panels along transverse fold lines, each of said top flaps being folded inwardly to form two respective cuffs within said opening for maintaining said bag in a maximally open position, each of said cuffs including a top edge defined by said transverse fold lines and a bottom edge parallel to said transverse fold lines, said top and bottom edges of said cuffs being separated by a distance of approximately one-third the distance x, each of said cuffs further including two outer edges of said cuffs seperated by a distance of approximately four times the distance x and extending downwardly and inwardly from said top edge toward said bottom edge, each of said cuffs frictionally engaging with and applying outward pressure on said gussets and said corners of said bag to prevent said width panels from collapsing inwardly and to maintain said bag in a maximally open position.

10. In a flexible folding bag having two pairs of opposing sidewalls, a bottom bridging across said sidewalls, a corner formed at each intersection of said sidewalls, and an opening formed between said sidewalls, one of said two pairs of opposing sidewalls comprising a pair of width panels, each of said width panels including a respective center score line defining a gusset, said width panels adapted to collapse inwardly along said respective center score lines, a hold-open top comprising:

a plurality of top flaps hingedly connected to top edges of said sidewalls along transverse fold lines, said top flaps being folded inwardly to form one or more cuffs within said opening, said one or more cuffs integrally extending about said corners, said gussets and said center score lines, said one or more cuffs engaging with and applying outward pressure on one or more of said gussets for maintaining said bag in a maximally open position.

11. The hold-open top of claim 10 wherein each of said one or more cuffs engages with and applies outward pressure on at least one of said center score lines to prevent said width panels from collapsing inwardly and to maintain said bag in a maximally open position.

12. The hold-open top of claim 11 wherein each of said one or more cuffs engaging with and applying outward pressure on at least one of the corners to maintain said bag in a maximally open position.

13. The hold-open top of claim 12 wherein each of said one or more cuffs include a top edge defined by said transverse fold lines, a bottom edge parallel to said transverse fold lines, and two outer edges each extending downwardly and inwardly from said top edge toward said bottom edge.

14. The hold-open top of claim 13 wherein said center score lines on said width panels are separated from adjacent ones of the corners of said bag by a distance x, and said top and bottom edges of each of said one or more cuffs are separated by a distance of approximately one-third of the distance x.

15. In a flexible folding bag having two pairs of opposing sidewalls, the sidewalls of said bag intersecting to define a plurality of corners, a bottom bridging across said sidewalls, and an opening formed between said sidewalls, one of said two pairs of opposing sidewalls comprising a pair of width panels, each of said width panels including a respective center score line defining a gusset, said center score lines on said width panels being separated from adjacent ones of the corners of said bag by a distance x, said width panels adapted to collapse inwardly along said respective center score lines, a hold-open top comprising:

a plurality of top flaps hingedly connected to top edges of said sidewalls along transverse fold lines, said top flaps being folded inwardly to form one or more cuffs within said opening, said one or more cuffs including a top edge defined by said transverse fold lines, a bottom edge parallel to said transverse fold lines, and two outer edges each extending downwardly and inwardly from said top edge toward said bottom edge, said two outer edges of each of said one or more cuffs being separated by a distance of approximately four times the distance x, said one or more cuffs frictionally engaging with and applying outward pressure on one or more of said gussets and at least one of said center score lines to prevent said width panels from collapsing inwardly and to maintain said bag in a maximally open position, each of said one or more cuffs engaging with and applying outward pressure on at least one of said corners to maintain said bag in a maximally open position.

16. A method of forming a reinforced hold-open bag, comprising the steps of:

supplying the bag with two pairs of opposing sidewalls, a bottom bridging across said sidewalls, a corner formed at each intersection of said sidewalls, an opening formed between said sidewalls, and a plurality of top flaps connected to top edges of said sidewalls along transverse fold lines, one of said two pairs of opposing sidewalls comprising a pair of width panels, each of said width panels including a respective center score line defining a gusset, said width panels adapted to collapse inwardly along said respective center score lines; and folding said top flaps inwardly within said bag opening to form one or more cuffs, said one or more cuffs integrally extending about said corners, said gussets and said center score lines, said one or more cuffs thereafter applying outward pressure to said gussets to maintain said bag in a maximally open position.

* * * * *